United States Patent [19]

McElhoe

[11] 4,041,659

[45] Aug. 16, 1977

[54] METAL BUILDING STRUCTURE

[76] Inventor: Hubert L. McElhoe, 1426 Brazos St., Graham, Tex. 76046

[21] Appl. No.: 613,252

[22] Filed: Sept. 15, 1975

[51] Int. Cl.[2] ..... E04B 7/02

[52] U.S. Cl. ..... 52/93; 52/639

[58] Field of Search ..... 52/90, 92, 93, 272, 52/274, 639, 478

[56] References Cited

U.S. PATENT DOCUMENTS

| | | | |
|---|---|---|---|
| 629,468 | 7/1899 | Ray | 52/93 |
| 1,893,636 | 1/1933 | Ridgway | 52/272 |
| 3,137,098 | 6/1964 | Elia et al. | 52/639 X |
| 3,224,151 | 12/1965 | Nystrom | 52/90 |
| 3,474,578 | 10/1969 | Wippermann | 52/639 |

*Primary Examiner*—J. Karl Bell
*Attorney, Agent, or Firm*—James C. Fails

[57] ABSTRACT

Disclosed herein is a metal building structure employing box beam upright columns and box beam rafters intermediate the columns, forming a double pitched roof. The columns are of uniform transverse rectangular cross section. The rafters are of transverse rectangular cross section, the height of the cross section increasing from the outer end to the peak of the roof. The lower sides of the rafters are perpendicular to the upright columns.

Purlins and girts fastened between the pairs of rafters and the pairs of columns are flush with the sides of the columns and rafters. The columns and rafters are bolted together and channeled passages adjacent the ends provide access to the bolts. An eave strut, connected between the outer ends of the rafters, protrudes outward sufficiently to cover ends of abutting side sheeting, avoiding the need for flashing. A sliding door mounting combines a bracket, carriage, and flashing in an integral piece. The sliding door is comprised of two rectangular frames joined by linking members that vary in size for doors of different height.

7 Claims, 8 Drawing Figures

Fig. 7
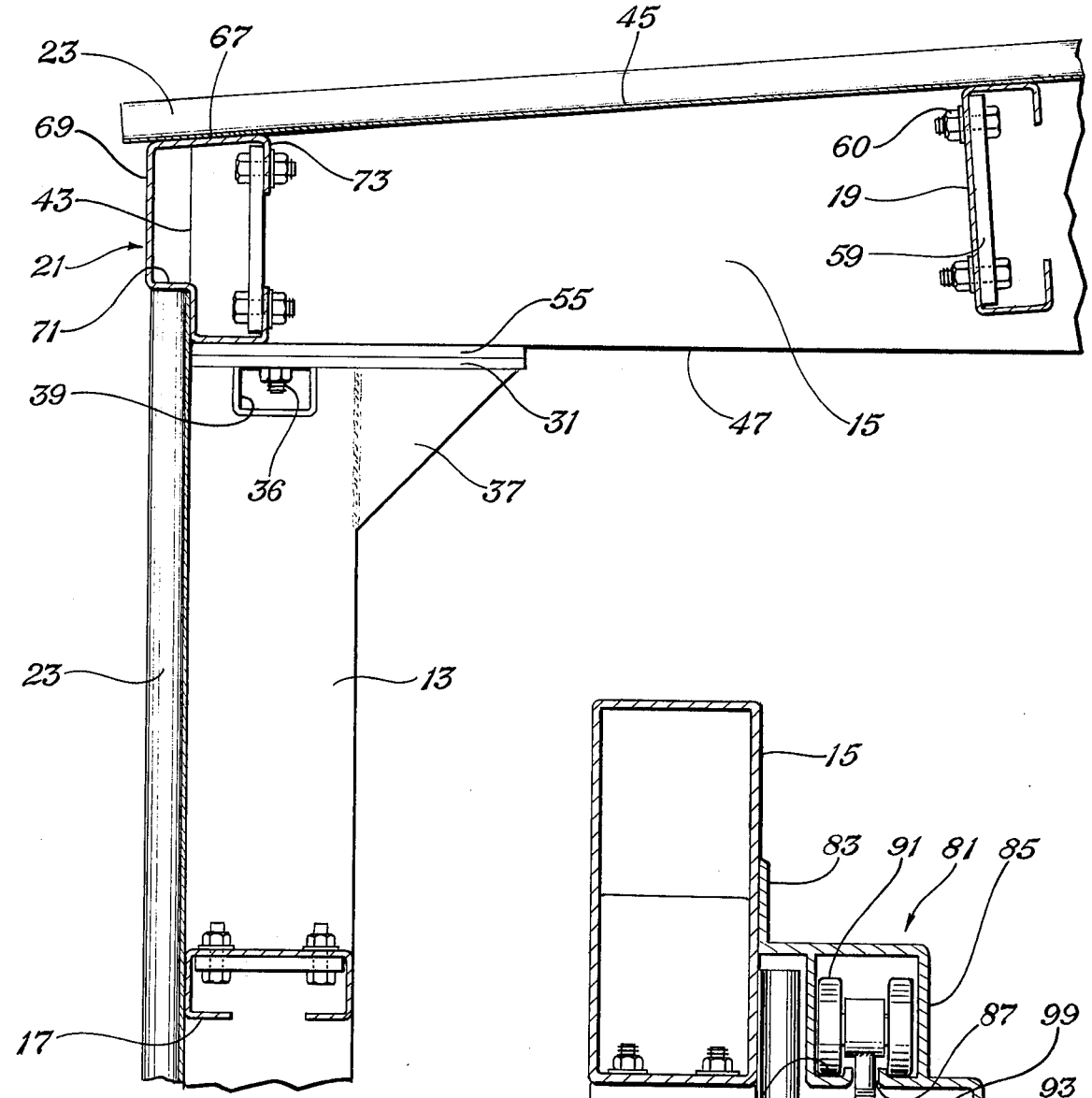
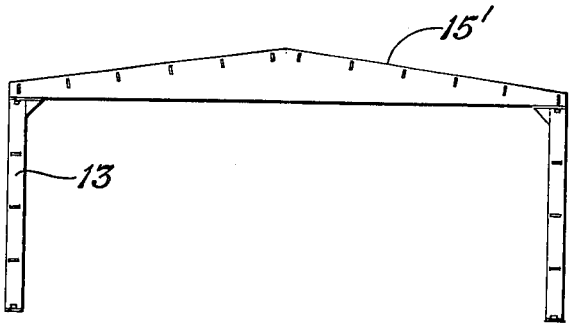
Fig. 8
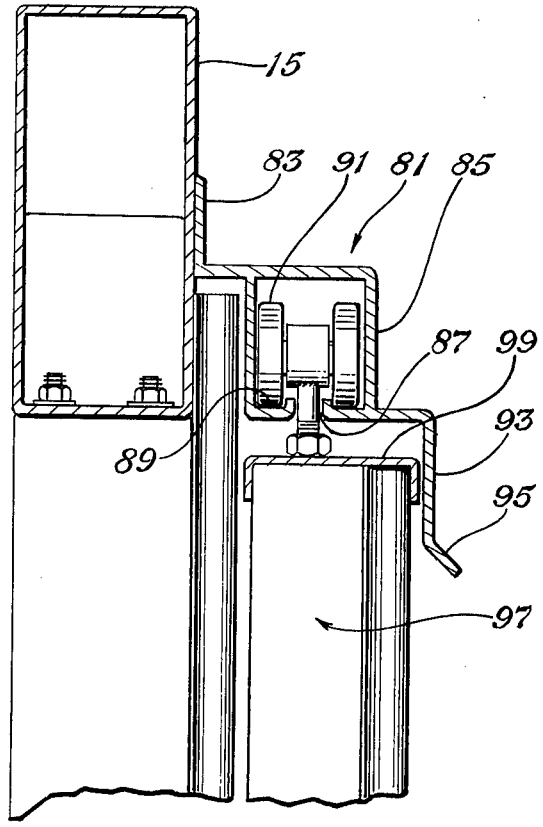
Fig. 4

METAL BUILDING STRUCTURE

BACKGROUND OF THE INVENTION

1. Field of the Invention

This invention relates to metal buildings; and, more particularly to the structural framework and sliding door therefor.

2. Description of the Prior Art

The prior art has disclosed buildings using a fairly lightweight metal structure to which metal sheeting is attached. The buildings ranged from the widely used Quonset huts of World War II to modern buildings. One of such buildings is described in U.S. Pat. No. 3,146,864, issued to Nystrom, et al., and another in U.S. Pat. No. 3,113,648, issued to Key, Jr.

Conventionally, the beams used in the structures contain flanges for bolting to other members. Normally, the girts, which are members fastened horizontally between upright columns, are not uniformly flush with the inner flanges. This results in a non-uniform structure on the interior, should it be desired to install interior walls. Should a ceiling be desired, additional horizontal members are needed. Improvements to the eave flashing, sliding door mounting and flashing, and sliding door, per se, are also desirable. Specifically the prior art has not been totally satisfactory in providing the following desirable features:

1. A structure for a metal building which presents a uniform interior and exterior surface, and utilizes a maximum amount of interior space.
2. An improved frame structure that is lightweight, strong, and easily assembled.
3. An improved eave flashing that eliminates the need for additional flashing.
4. An improved door mounting that is easily installed and eliminates the need for separate flashing.
5. An improved door that is easily changeable to different lengths.

SUMMARY OF THE INVENTION

It is accordingly a general object of this invention to provide an improved metal building that has one or more of the desirable features delineated hereinbefore and not heretofore provided.

It is a further object of this invention to provide a metal building that has a plurality of the delineated desirable features.

These and other objects will be apparent from the descriptive matter hereinafter, particularly when taken in conjunction with the appended drawings.

In accordance with these objects a structure having box beam columns and rafters is provided. Girts are fastened flush with the sides of the columns, providing a smooth wall supporting structure. Eave struts extend outwardly from the rafter ends, covering the abutting ends of the side sheeting and eliminating the need for flashing. A door mounting comprises an integral member having a bracket for coupling directly to a rafter, a carriage for the door sliding means, and a flashing. The door has intermediate telescoping members that allow the size of the door to vary.

BRIEF DESCRIPTION OF THE DRAWINGS

FIG. 1 is an isometric view of a portion of a metal building structure in accordance with this invention.

FIG. 4 is an enlarged end view of the left side of the door mounting and door of FIG. 3.

FIG. 7 is an enlarged partial elevational view of the upper left corners of the structure of FIG. 1, with sheeting installed.

FIG. 8 is a reduced side elevational view of an alternate embodiment of the structure of FIG. 1.

DESCRIPTION OF THE PREFERRED EMBODIMENT

Figure 2:
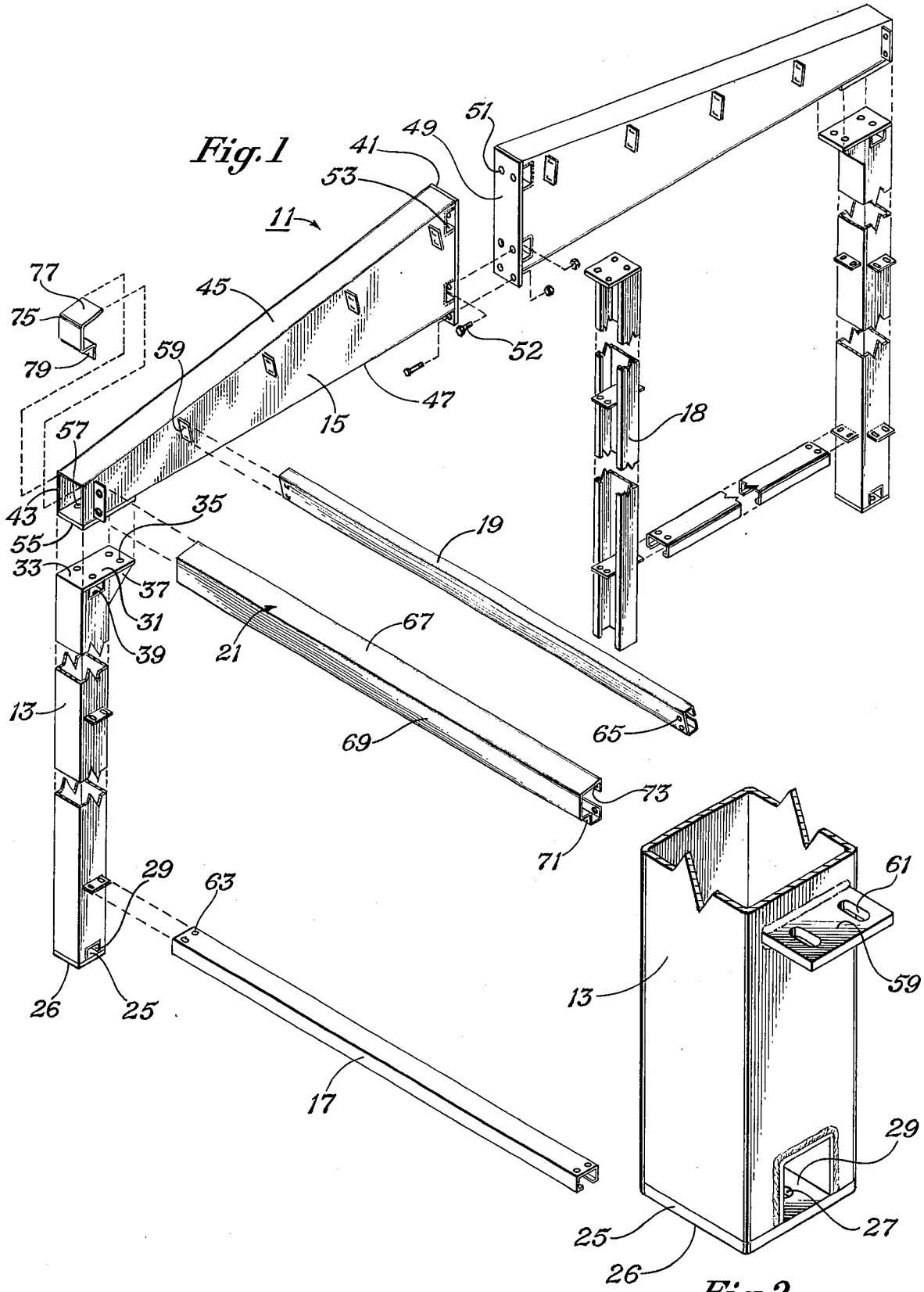
FIG. 2 is an enlarged partial isometric view of one of the columns of FIG. 1.

The following descriptive matter is given with respect to one commercially successful building. The dimensions and other specific information will, of course, be designed to suit the use and size of the structure, or building; and should not be viewed in a limiting sense.

Referring to FIG. 1, a metal building structure 11 is shown comprising a pair of upright columns 13 spaced apart with a pair of rafters 15 connected to the columns 13 and to each other intermediate the columns 13. There will be several sets of columns 13 and rafters 15; for example, spaced normally in 20 foot intervals. Vertical members 18 are spaced as needed intermediate columns 13, as at the ends of the building structure. Between adjacent columns 13 along a wall, several girts 17 are connected along the sides and ends of structure 11. Between each rafter 15, several purlins 19 are connected along the top of structure 11. Eave struts 21 are connected between rafters 15 adjacent the top of columns 13. Columns 13, rafters 15, girts 17, purlins 19, vertical end members 18 and eave struts 21 are interconnected and covered with sheeting 23, FIGS. 3, 4, 6 to form a rectangular building structure having a peaked roof.

Referring to FIG. 2, each column 13 is a box beam having a rectangular transverse cross section and constructed of approximately seven gauge metal. The cross sectional size is uniform throughout its length. As illustrated, the box column is square with each side being approximately 6 inches wide. A metal plate 25 having apertures 27 is welded across the bottom end 26 of column 13. Studs (not shown) may be inserted through apertures 27 and nuts tightened against the plate 25 to anchor the columns 13 to the foundation.

A channeled passage 29 extends through column 13 adjacent apertures 27 for providing access to the nuts of the studs, or bolts. Passage 29 is formed by cutting a rectangular section from the side of column 13 adjacent the bottom, fitting a channel member between the removed sections, then welding the channel member to the sides of the column.

Another plate 31, FIG. 1, is welded across the top end 33 and has apertures 35 for the insertion of bolts and nuts 36, FIG. 7. Plate 31 extends inwardly a short distance and is reinforced by a gusset 37. A passage 38 similar to passage 29 provides access to bolts and nuts 36 used in coupling the column 13 to rafter 15. Plates 25 and 31 are positioned perpendicular to the longitudinal axis of column 13 and are flush with the sides of the column.

Referring to FIG. 1, rafter 15 is also a box beam having a rectangular transverse cross section and metal thickness similar to that in the columns 13. Rafter 15 has an inner end 41 which joins its mating rafter to form the peak of the roof, and an outer end 43 which is attached to columns 13. The outer end 43 is smaller than the inner end 41, resulting in a sloping top side 45. Top side 45 slopes upwardly typically one inch per foot, with the bottom side 47 remaining horizontal or perpendicular to the longitudinal axis of column 13. Consequently, each rafter 15 has a quadrilateral vertical cross section with parallel inner and outer ends 41, 43, a bottom side 47 perpendicular to the ends, and a top side 45 at an acute angle with respect to the bottom side 47 equal to the desired roof slope.

Inner end 41 has a plate 49 welded transversely thereacross and having apertures 51 for coupling the rafters together. Plate 49 extends downwardly for a short distance for additional coupling, the sides and top of plate 49 being flush with the rafter. Passages 53 are located adjacent apertures 51 and are similar to passages 29 and 39 in that they provide access to coupling bolts and nuts 52, eliminating the need for external flanges.

Rafter 15 has a plate 55 welded to bottom side 47 adjacent its outer end 45. Plate 55 has apertures 57 which mate with apertures 35 for bolting the rafter to the column. Rafters 15 and columns 13 are formed by welding plates between two opposing channel members. The pair of rafters 15 could be formed in a single integral box beam 15, having a double slope, as shown in FIG. 8.

A plurality of clips 59, FIGS. 1, 2 and 7; are fastened, preferably by welding, to rafters 15 and columns 13 and serve as attaching means for purlins 19 and girts 17. Each clip 59 is a substantially planar plate extending normal from the surface to which it is welded and has slotted apertures or slots 61 through which bolts and nuts 60, FIG. 7, are inserted to couple purlins 19 and girts 17. The clips 59 that are attached to columns 13 and vertical end members 18 are transverse to the longitudinal axis of each. The clips 59 attached to rafters 15 are substantially perpendicular to plate 55, and are adjacent the top side 45. They may also be vertically mounted.

Purlins 17 and girts 19 are similar, having a transverse cross section that is C-shaped as shown in FIG. 7 and having apertures 63, 65 for alignment with slots 61. Purlins 19 are typically 8 inches in width. Girts 17 are normally 6 inches in width, and both 20 feet long. Both are relatively lightweight, typically 16 gauge metal, or 1/16 inch thick. Vertical end members 18 are similar to girts 17 and purlins 19. End members 18 do not function as weight bearing members and are used to support sheeting 23. The purlins 19 and girts 17 are connected to rafters 15, columns 13, and vertical end members 18 by inserting them over the respective clips 59, then bolting. Girts 17 will be flush with the outer and inner sides of columns 13 and vertical end members 18. Purlins 19 will be substantially flush with the top side 45 of rafters 15.

Referring to FIGS. 1 and 7, eave strut 21 fastens to a plate or clip 59 adjacent outer end 43 of rafter 15. Eave strut 21 has a top side 67 that is of slope equal to the top side 45 of rafter 15. Top side 67 extends outwardly past the end 43 of rafter 15 for a distance slightly greater than the width of conventional sheeting 23. Outer side 69 extends downwardly and has a shoulder 71 indented flush with the outer end 43 of rafter 15. Flanges 73 converge inwardly from top side 67 and shoulder 71 for coupling clip 59.

Referring to FIG. 1, a cap 75 is bolted directly to the other end 43 of rafter 15, and fits flush with eave strut 21. Cap 75 has a top side 73 which fits over the top side 45 of rafter 15, and extends outwardly to cover the abutting ends of sheeting 23. Cap 23 has a shoulder 79 indented and fastened directly to rafter 15 and the outer side of column 13. Consequently, a smooth continuous eave is provided by eave strut 21 and cap 75.

Sheeting 23 is installed on the sides of structure 11 with the upper end abutting the overhang formed by shoulders 71, 79. The overhang eliminates the need for sealing the upper apertures of the sheeting corrugation, and additional flashing is not required. Sheeting 23 is installed on the roof by directly fastening it to rafters 15 and purlins 19. Sheeting 23 adjacent the outer end of the roof will be placed over the top side 67, 77 of eave strut 21 and clip 75.

Figures 3, 5, 6:
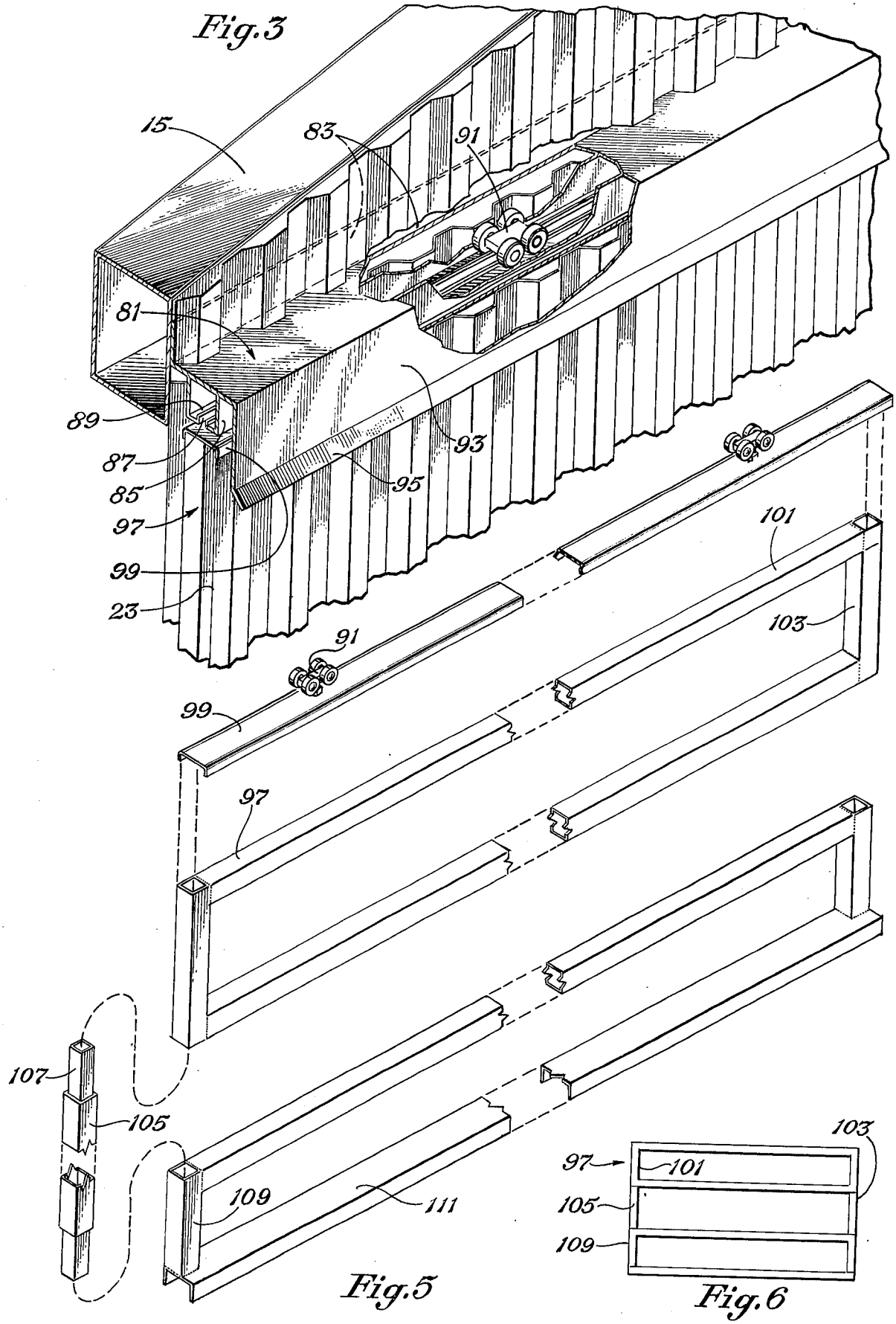
FIG. 3 is an enlarged partial isometric view, partially in section, of a door mounting and door in accordance with the invention.
FIG. 5 is an exploded partial isometric view of the frame of a sliding door in accordance with the invention.
FIG. 6 is a reduced front elevational view of the door frame of FIG. 5.

Referring to FIGS. 3 and 4, a sliding door mounting 81 is shown attached to a front rafter 15. The mounting 81 has an L-shaped bracket 83 for fastening to the rafter 15. A carriage member 85, suspended below the bracket 83, has a rectangular vertical cross section with a slot 87 along the bottom. Slot 87 defines a pair of tracks 89 for carrying the door sliding means, or a carriage on wheels, 91. Carriage member 85 is suspended by bracket 83 away from rafter 15 sufficiently for sheeting 23 to be inserted and abut with bracket 83.

A flashing 93 extends from the lower edge of carriage member 85. Flashing 93 has an out-turned lip 95 to deflect rain away from the structure. The sliding door mounting 81, including bracket 83, carriage member 85, and flashing 93, is comprised of a single integral piece. The length of sliding door mounting 81 is sufficient for a door to fully open. The sliding door mounting 81 is installed by initially tack welding or applying a few holding screws, then permanently anchoring it with the sheeting over bracket 83 by utilizing the same fasteners as used with the sheeting; for example, metal screws or bolts.

Referring to FIGS. 3–6, a sliding door frame 97 is shown carried by the sliding door mounting 81, and comprises the door sliding means 91 to which a channel member 99 is affixed. An upper rectangular frame 101 is fastened to the channel member 99. The side members 103 of frame 101 are hollow and have open lower ends. Linking members 105 have a reduced portion, or neck, 107 on opposite ends which will extend into side members 103. A lower rectangular frame 109 fits onto the lower neck 107 of linking members 105. Lower frame 109 has a bottom channel member 111, of width approximately equal to channel member 99. Channel member 111 faces downward and slides over a guide (not shown) embedded in the floor or ground. The upper surface of channel member 111 provides support and closure for abutting sheeting 23. Linking member 105 is welded or otherwise fastened to upper and lower frames 103, 109. Frames 101, 109 are prefabricated, with linking members 105 being of various sizes to provide doors of different lengths. The frames 101 may be of same or different vertical dimensions; for example, within the range of 2–5 feet in height. Sheeting is installed over the door frame 97, with the upper ends abutting channel member 99 and the lower ends abutting channel member 111. The external sliding door assembly comprises the sliding door mounting 91 and sliding door frame 97.

It can readily be seen that an invention that achieves the objects delineated hereinbefore and having significant improvements has been provided. The box beam construction is strong, lightweight, and easy to assemble. The inner space has flush columns and rafters for installing wallboard with a minimum of wasted space. The relatively low pitch of the roof allows a high inner clearance height without wasted space in the peak. The eave strut eliminates the need for flashing and sealing the sheeting. The door mounting does not require additional flashing and is fast to install. The door may be particularly prefabricated and is adaptable to various heights without modification.

Although the invention has been described with a certain degree of particularity, it is understood that the present disclosure has been made only by example and that numerous changes may be resorted to without departing from the spirit and scope of this invention.

What is claimed is:

1. A metal building structure comprising:

pairs of spaced upright columns, each column having a rectangular transverse cross section of uniform size throughout its length;

pairs of rafters, each rafter having an outer end carried by one of the columns and connected to its mating rafter intermediate the columns to form a double pitched roof support; each rafter having a rectangular transverse cross section that increases in height from the outer end to the inner end; each rafter having a quadrilateral vertical cross section with parallel outer and inner ends, a bottom side perpendicular to the ends, and a top side at an acute angle with respect to the bottom side equal to a desired roof slope; the rafter's bottom side being substantially perpendicular to the longitudinal axis of the column; the bottoms of said rafters being co-planar and when installed lying in a flat, substantially horizontal plane facilitating installation of a ceiling;

a plurality of purlins fastened transversely between each pair of rafters, with the top side of each purlin substantially flush with the top side of the rafter; and a plurality of girts fastened transversely between each pair of columns, with the sides of the girt substantially flush with the sides of the column so as to be co-planar therewith and facilitate installation of an interior wall.

2. The structure of claim 1 further comprising a first plate, having apertures, welded transversely across the top end of each column, the sides of the plate being flush with the sides of the column;

a second plate, having apertures, welded transversely across the bottom end of each column, the sides of the plate being flush with the sides of the column; and a third plate, having apertures, welded to the bottom side of each rafter adjacent its outer end, the sides of the plate being flush with the sides of the rafter;

said columns and rafters being connected together by bolts inserted through the apertures of the first and third plates;

said columns being anchored by studs inserted through the apertures of the second plate.

3. The structure of claim 2 further comprising a fourth plate, having apertures, welded transversely across the inner end of each rafter, the top and sides of the plate being flush with the sides of the rafter;

said rafters being connected together by bolts inserted through the apertures of the plates.

4. The structure of claim 2 further comprising a channeled passage through each column, adjacent the first and second plates for access to the bolts.

5. The structure of claim 1 wherein each pair of rafters comprises a single integral beam.

6. The structure of claim wherein the purlins and the girts have a C-shaped transverse cross section, the structure further comprising:

a plurality of clips each having a configuration of a substantially planar surface having slotted apertures spaced and fixedly attached to the columns and rafters, the dimensions of the clips allowing the purlins and girts to be inserted closely thereover; and the purlins and girts being bolted to the clips.

7. The structure of claim 1 further comprising:

an eave strut connected between the outer ends of the rafters, said eave strut having a top side mounted flush with the top side of the rafter, and having an outer side protruding outward from the outer end of the rafter sufficiently to cover the ends of abutting side sheeting and avoiding the necessity for flashing; said eave strut being bolted to plates welded to the rafters.

* * * * *